US005997344A

United States Patent [19]

Shinozaki

[11] Patent Number: 5,997,344

[45] Date of Patent: Dec. 7, 1999

[54] CONNECTOR

[75] Inventor: Tetsuya Shinozaki, Yokkaichi, Japan

[73] Assignee: Sumitomo Wiring Systems, Ltd., Japan

[21] Appl. No.: 09/088,061

[22] Filed: Jun. 1, 1998

[30] Foreign Application Priority Data

Jun. 30, 1997 [JP] Japan ..... 9-174624
Sep. 17, 1997 [JP] Japan ..... 9-252169

[51] Int. Cl.[6] ..... H01R 3/00

[52] U.S. Cl. ..... 439/489; 439/188

[58] Field of Search ..... 439/489, 352, 439/490, 188, 586, 587, 589, 595, 598, 271, 189, 357, 358, 519, 521

[56] References Cited

U.S. PATENT DOCUMENTS 4,735,578 4/1988 Reichardt et al. ..... 439/152
5,114,359 5/1992 Chishima et al. ..... 439/271
5,145,356 9/1992 Minnis .
5,179,343 1/1993 Chishima et al. ..... 324/528
5,334,034 8/1994 Reichardt et al. ..... 439/188
5,562,486 10/1996 Saijo et al. .
5,613,872 3/1997 Fukuda et al. .
5,651,693 7/1997 Fukuda et al. .
5,709,563 1/1998 Saito ..... 439/275
5,848,912 12/1998 Okabe ..... 439/489
5,863,216 1/1999 Tsuji et al. ..... 439/489

*Primary Examiner*—Paula Bradley
*Assistant Examiner*—Alexander Gilman
*Attorney, Agent, or Firm*—Banner & Witcoff, Ltd.

[57] ABSTRACT

In order to detect via an external circuit whether male and female connector housings 1 and 2 have been correctly fitted together, a short-circuiting terminal 19 which bends when a locking arm 10 bends either short circuits or fails to short circuit a pair of detecting terminals 7 located on the male housing 1. The area surrounding the short-circuiting terminal 19 is surrounded by an interior protecting wall which is covered by a flexible sealing cover 27. The sealing cover covers only the short-circuiting terminal and the locking arm remains exposed. The upper face of the interior protecting wall has an opening 25A. When the locking arm 19 is bent while the housings are being fitted, the short-circuiting terminal 19 is moved via the sealing cover 27 and the short-circuiting terminal and the detecting terminals 7 separate.

13 Claims, 7 Drawing Sheets

CONNECTOR

TECHNICAL FIELD

The present invention relates to an electrical connector.

BACKGROUND TO THE INVENTION

Conventionally, connectors are provided with fitting detecting terminals which detect electrically whether male and female connectors have been fitted together correctly. For example, a pair of fitting detecting terminals is provided on one connector housing, and the other is provided with a short-circuiting terminal and a locking arm. When the two connector housings are correctly fitted together, the short-circuiting terminal short-circuits the two detecting terminals by making contact with them. The locking arm locks the connector housings in a fitted state. Typically, while the connector housings are being fitted, the locking arm is used to bend the short-circuiting terminal away from the detecting terminal as the locking arm bends; when the connectors are in a correctly fitted state, the return of the locking arm is used to return the short-circuiting terminal to its original position, thereby short-circuiting the detecting terminal. By this means, the fitting detecting function is realised.

However, in this type of connector, in which the fitting detection is carried out through the bending of the locking arm, the locking arm must be operated from the exterior. As a result, an open configuration tends to be employed. This kind of configuration is unsuitable for locations which require waterproofing. Currently, the waterproofing requirement cannot be met with this type of fitting detecting configuration.

The present invention has been developed after taking the above problem into consideration, and aims to present a fitting detecting connector which is provided with a waterproofing function.

SUMMARY OF THE INVENTION

According to the invention there is provided an electrical connector having an exposed bendable latch arm for engagement with a mating connector in the fully fitted condition, and a short-circuit terminal engageable with a detecting terminal of a mating connector so as to complete an electrical circuit only in the fully fitted condition, characterized in that said short-circuit terminal is protected from moisture by a flexible sealing cover and is movable by said exposed latch arm acting through said cover.

The sealing cover ensures that the short-circuit terminal is operable by the latch arm but is nevertheless sealed from the exterior, and particularly from moisture. The arrangement makes it unnecessary to provide a boot for the entire connector, which would substantially reduce operability.

Preferably the short-circuit terminal is housed in an open ended chamber sealed by a resilient boot constituting said cover. The chamber is preferably tubular, and the boot engages the wall thereof resiliently or with the aid of adhesive.

The latch arm and cover may be attached, by for example adhesive so as to move in a unified manner; friction is avoided, and this arrangement ensures that the cover is urged away from the short-circuit terminal.

A protecting member is preferably provided between the cover and the short-circuit terminal so as to avoid cutting or shaving of the cover.

BRIEF DESCRIPTION OF THE DRAWINGS

Other features of the invention will be apparent from the following description of several preferred embodiments shown by way of example only in the accompanying drawings, in which.

DESCRIPTION OF PREFERRED EMBODIMENTS

A first embodiment of the present invention is described with the aid of FIGS. 1 to 6.

Figure 1:
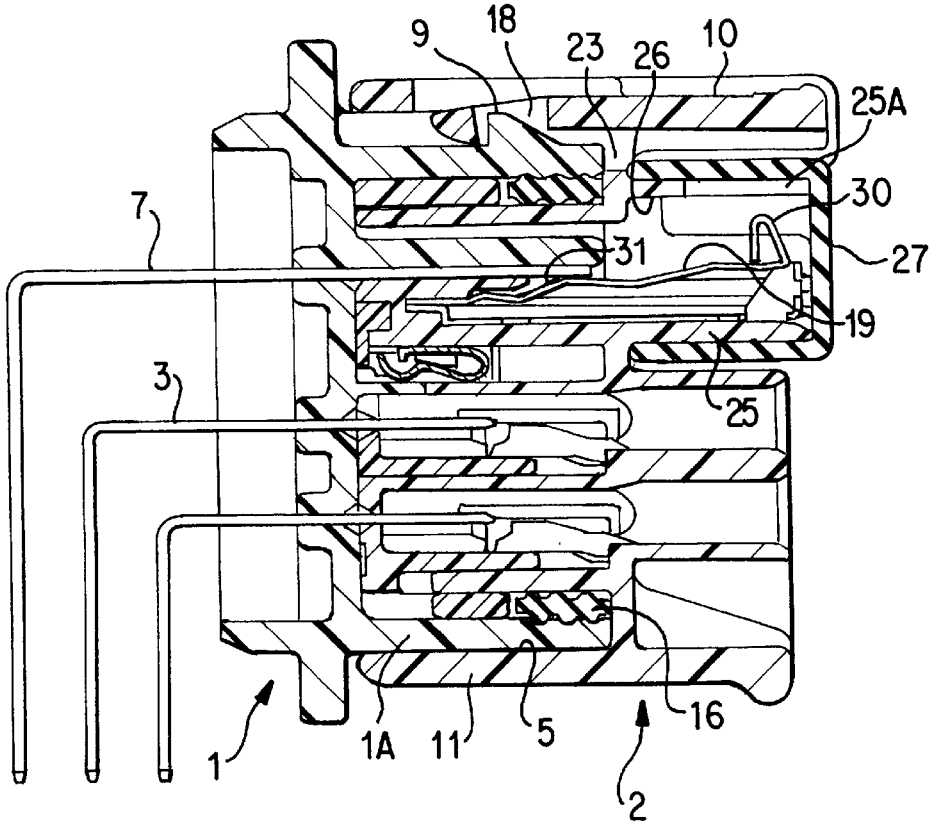
FIG. 1 is a cross-sectional view of a first embodiment showing a connector in a fitted state.
Figure 2:
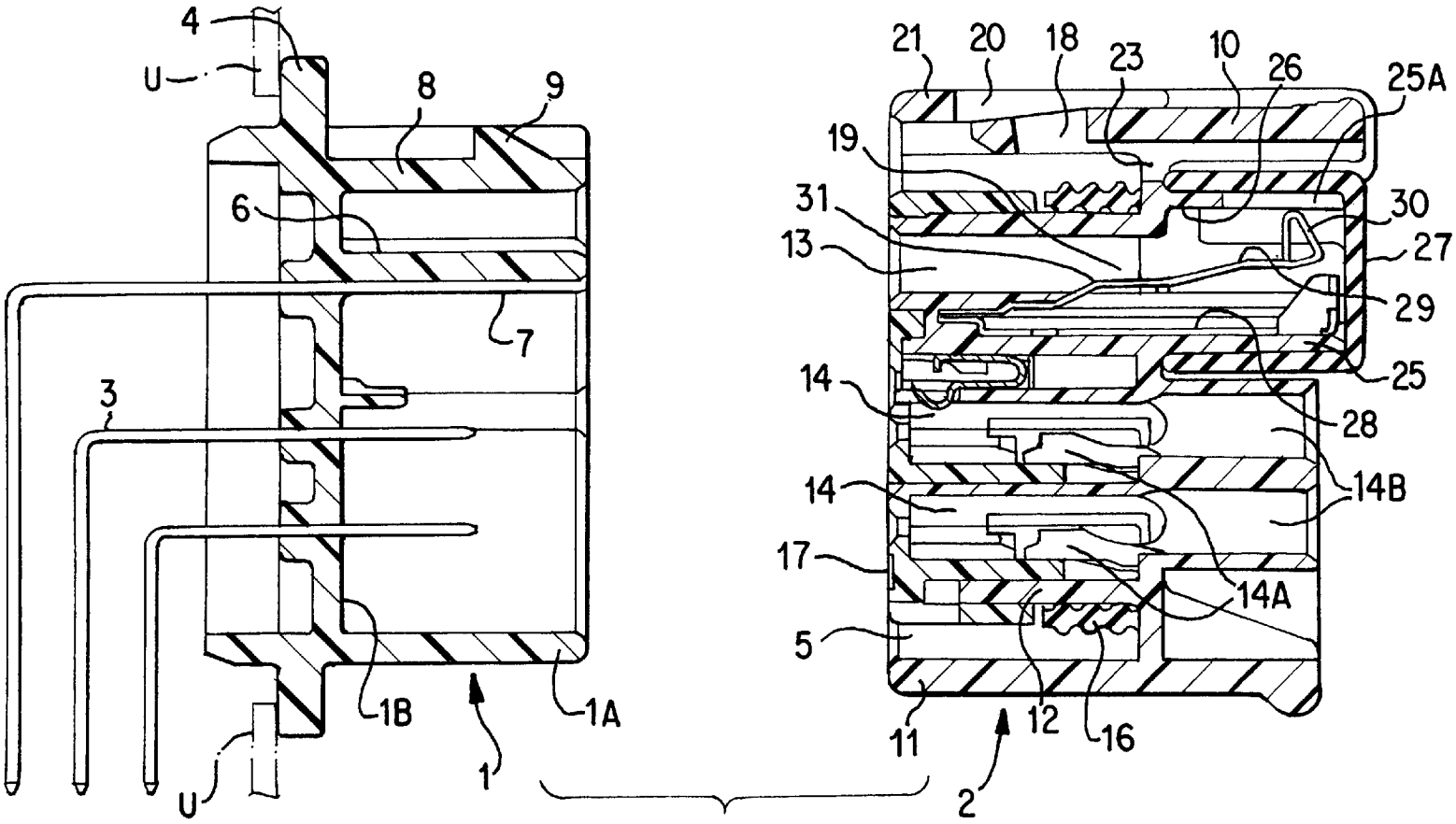
FIG. 2 is a cross-sectional view showing the connector in a state prior to being fitted.

The right side of FIG. 2 shows a female connector, and the left side shows a male connector. The male connector has a synthetic resin male housing 1, and protruding from the exterior face thereof is a flanged edge 4 which is used for attachment in any suitable manner. For example, a securely watertight computer unit U used in a motor vehicle can be attached thereto by means of tightening a clamp. The male housing 1 has an angular tubular member 1A which fits within a fitting space 5 of the female connector. The interior of the male housing 1 has a plurality of male terminal fittings 3. One end of each male terminal fitting 3 protrudes from the rear face of the male housing 1 and is bent downwards, the end portions thereof being connected to a circuit board (not shown), and the other ends being arranged in a parallel manner within the angular tubular member 1A and protruding therefrom.

Within the male housing 1, a protecting member 6 protrudes at right angles from a rear face wall 1B towards the open face. On the lower face of the protecting member 6 a pair of detecting terminals 7 (these form a pair located respectively at closer and father sides in FIG. 1) are provided in a parallel manner and are separated by a specified distance. Like the male terminal fittings 3, each detecting terminal 7 extends outwards to the exterior of the male housing 1 and is attached to a circuit board (not shown).

A fitting protrusion 8 protrudes in a parallel manner above the protecting member 6. This fitting protrusion 8 is formed so that its length extends from the rear face wall 1B to the open face. In addition, a fitting protruding member 9 protrudes from the upper face of the fitting protrusion 8. When the male and female connectors are fitted together, the fitting protruding member 9 raises the anterior end of a locking arm 10 and, when the two housings are correctly fitted together, it fits in a resilient manner with a locking hole 18 of the locking arm 10 and maintains the fitted state of both connectors.

Like the male connector, the female connector has a synthetic resin female housing 2, the outer circumference wall of which forms an angular tube-shaped hood member 11 into which the male housing 1 fits. In the hood member 11 is a terminal housing member 12 and a detecting chamber 13 (to be described later), the terminal housing member 12 having a plurality of cavities 14 located in an anterior-posterior direction, each corresponding to a male terminal fitting 3. A female terminal fitting (not shown) is installed from the posterior side (the right side in FIG. 2) within each cavity 14, and each of these is retained by a bendable lance 14A in a resilient manner. When the male and female housings are correctly fitted together, the male and female terminal fittings are electrically connected.

The outer circumference portion of the terminal housing member 12 comprises a ring-like fitting space 5 located between the terminal housing member 12 and the hood member 11, and into this fitting space 5 the angular tubular member 1A of the male housing 1 can be inserted. It is fitted with a sealing ring 16 and its anterior portion is provided with a retainer 17. When the male housing is separated from the female housing, this retainer 17 prevents the sealing ring 16 from also coming out.

Furthermore, since a portion of the retainer 17 extends into the range of bending of the lance 14A, the retainer 17 limits the bending of the lance and thereby further prevents the removal of the female terminal fitting.

The electric wires (not shown) which connect with each female terminal fitting are fitted with a sealing rubber plug (not shown). The plugs are inserted into a tubular sealing portions 14B protruding from the posterior end of each cavity 14, and thus the seal towards the side of the electric wire can be maintained.

Inside the terminal housing member 12 (the central portion in the figure) is the detecting chamber 13 which houses a short-circuiting terminal 19. The detecting chamber 13 passes from the anterior to the posterior of the female housing 2. When the male housing 1 and the female housing are fitted together, the opening in the anterior face of the detecting chamber 13 accommodates the detecting terminals 7 and the supporting member 6 of the male housing 1.

On the upper face of the female housing 2 a pair of external supporting walls 20 are located in an anterior-posterior direction. The anterior ends of these external supporting walls 20 are connected by a linking member 21, the lower side of which has an opening to allow the passage of the fitting protrusion 8 of the male housing 1. Further, the external supporting walls 20 extend from the upper face to the rear face of the female housing 2, and the sections thereof on the rear face constitute extension walls 22.

The locking arm 10 is located between the external supporting walls 20. In the approximate centre by a support 23, and can move in a see-saw fashion with the support 23 as centre. The posterior end of the locking arm 10 relative to the support 23 is the operating side, and the anterior side is the locking end. At the tip of the locking end is the locking hole 18 which fits with the fitting protruding member 9 of the male housing 1 when the female housing is correctly fitted. At the operating end, stopping members 24 protrude on the left and right to prevent excessive bending.

An interior protecting wall 25 projects between the extension walls 22 on the rear face of the female housing 2. This interior protecting wall 25 opens out in the upwards and posterior directions and forms an approximately angular tubular shape. However, the portion around the base of an opening 25A of the upper face is configured such that it has an overlapping edge 26 of a specified length. This length of the overlapping edge 26 is such that it will fit adequately with a sealing cover 27 (to be described later) when the sealing cover 27 covers the interior protecting wall 25. This retains the sealing cover 27 and ensures that the seal can be maintained.

The interior of the interior protecting wall 25 is linked to the detecting chamber 13 and faces the free end of the short-circuiting terminal 19.

The lower face of the short-circuiting terminal 19 has an installation member 28, the anterior edge of which is bifurcated and folds back upon itself to form a pair of bendable members 29 which have a spring-like quality. By pushing the folded back portion of the anterior edge of the short-circuiting terminal 19 into the corresponding wall face of the detecting chamber 13, the short-circuiting terminal 19 is prevented from being removed. The posterior ends of the bendable members 29, protruding upwards and bent into an inverted V-shape, form connecting protrusions 30 which correspond to the bending operation of the locking arm, the tips of these connecting protrusions 30 being bridged together. Moreover, on the upper face of the bendable members 29 in a position anterior to the connecting protrusions 30 protrude a pair of contact members 31 which make contact with the detecting terminals 7 only when the housings 1 and 2 are correctly fitted together. The detecting terminals 7 short circuit and thus it can be detected whether the housings 1 and 2 are correctly fitted together.

The connecting protrusions 30 are located below the operating side of the locking arm 10. While the two housings are being fitted together, the bending operation of the locking arm 10 causes the bendable members 29 to bend in the sealing cover 27 (described below) and the contact members 31 are in a state of non-contact with the detecting terminals 7. When the housings 1 and 2 are correctly fitted together, the bendable members 29 bend back to their original position and cause the contact members 31 to short circuit the detecting terminals 7.

The sealing cover 27 is attached to the interior protecting wall 25 and the overlapping edge 26. The sealing cover 27 is made from a resilient material, such as rubber (which, depending on the circumstances of use, should be heat resistant and corrosion resistant), and is attached with adhesive to the interior protecting wall 25. The sealing cover 27 forms a box shape with one open face and is attached from the rear of the interior protecting wall 25 such that its entire open side protrudes towards the wall face. As a result, the interior of the interior protecting wall 25, such as the short-circuiting terminal 19 etc., is waterproofed with respect to the detecting chamber 13. As the sealing cover 27 is flexible, the connecting protrusions 30 of the short-circuiting terminal 19 can be pressed down from above the sealing cover 27 at the time when the operating end of the locking arm 10 is bent downwards.

Figure 3:
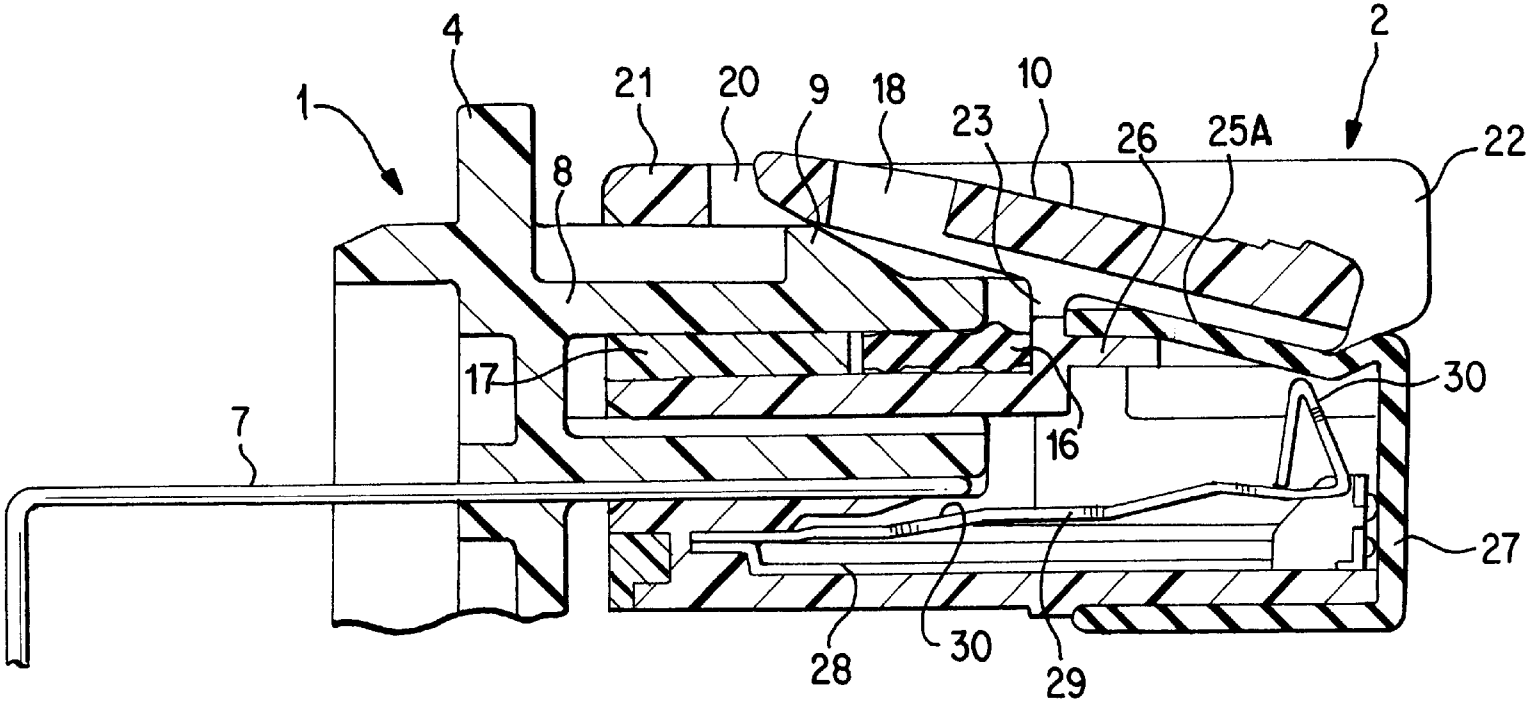
FIG. 3 is an enlarged cross-sectional view illustrating the approximate positions of components during the fitting operation.
Figure 4:
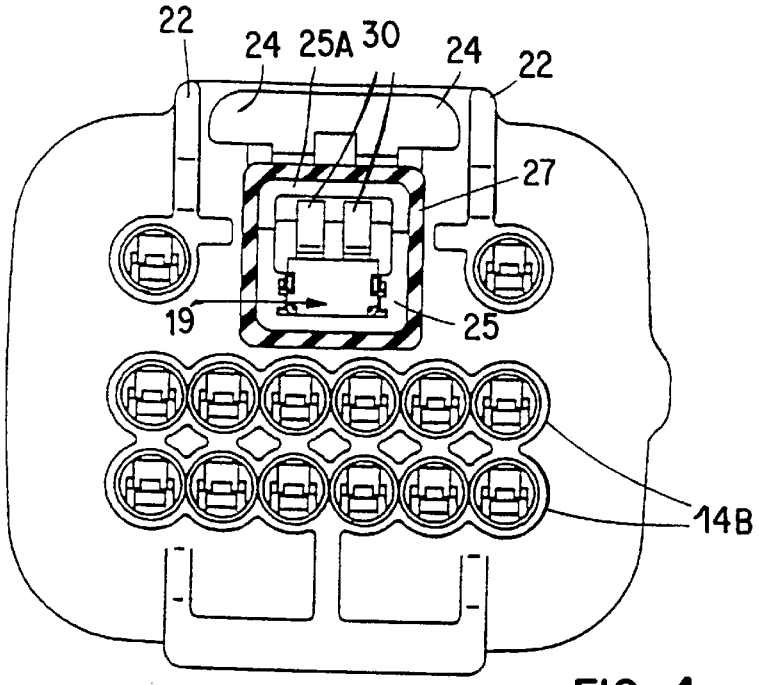
FIG. 4 is a rear face view of a female connector housing.
Figure 5:
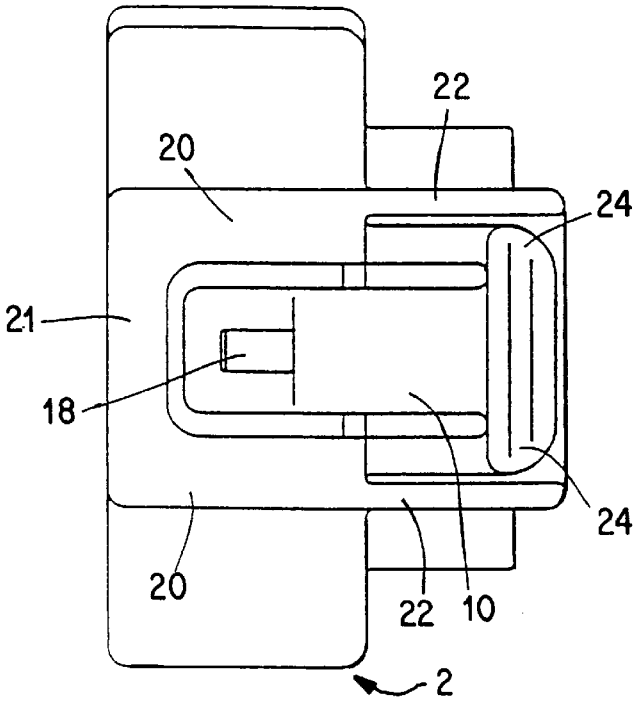
FIG. 5 is a plan view of the female connector housing.
Figure 6:
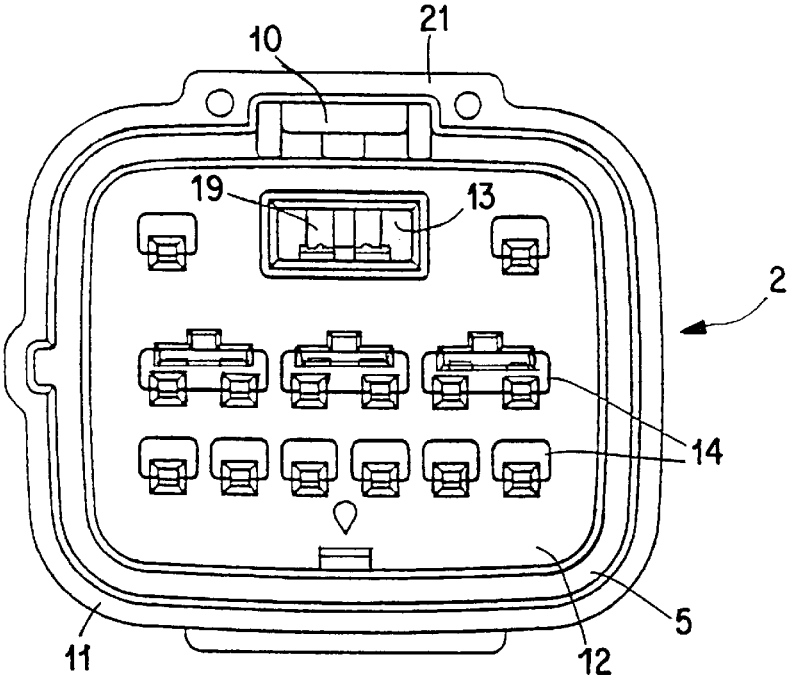
FIG. 6 is a front view of the female connector housing.

When the connectors are fitted together, the anterior end of the male housing 1 enters the fitting space 5 of the female housing 2. During this fitting operation, the fitting protrusion 8 enters between the external supporting walls 20, and the fitting protruding member 9 presses upon and raises the locking end of the locking arm 10. Conversely, when the operating end of the locking arm 10 is pushed downwards, as shown in FIG. 3, a portion of the sealing cover 27 is pushed into a concave shape. As a result, the connecting protrusions 30 of the short-circuiting terminal 19 are pushed and the bendable members 29 bend downwards. Consequently, in this state the contact members 31 are also bent downwards and are in a state of non-contact with the detecting terminals 7.

As the fitting of the housings 1 and 2 proceeds further and they reach a correct fitted state, the fitting protruding member 9 fits into the locking hole 18 and the locking arm 10 returns to its original position. In reaction to this the short-circuiting terminal 19 also returns to its original position. In consequence, the contact members 31 make contact with the detecting terminals 7, which are short-circuited, and the external circuit electrically detects that the housings are correctly fitted together.

If the housings 1 and 2 are not correctly fitted together, the locking arm 10 is maintained in a state where it is pushed up by the fitting protruding member 9 and is bent backwards and downwards. As a result, the short-circuiting terminal 19 also remains in a bent state and the short-circuit between the detecting terminals 7 does not occur. In this manner, it can be electrically detected that the housings are not correctly fitted together.

According to the first embodiment, waterproofing of the fitting portions of the housings 1 and 2 is maintained by the sealing ring 16. The cavities 14 are maintained in a sealed state by rubber sealing plugs, and the entire detecting chamber 13 is covered and waterproofed by the sealing cover 27. As a result, water is prevented from entering the housing from any of these points. Although the sealing cover 27 covers only the short-circuiting terminal 19 and the locking arm 10 remains exposed, the bending operation of the locking arm 10 can be transmitted to the short-circuiting terminal 19 via the superior resilience of the sealing cover 27. As a result, in the case where a pushing operation in performed on the locking arm 10 to release the lock, this operation can be performed directly on the locking arm 10. Consequently, there is improved operability.

Further, although the upper side of the interior protecting wall 25 is open, since the overlapping edge 26 is arranged to fit with the sealing cover 27, the attachment of the sealing cover 27 and consequently the reliability of the seal is maintained.

Figure 7:
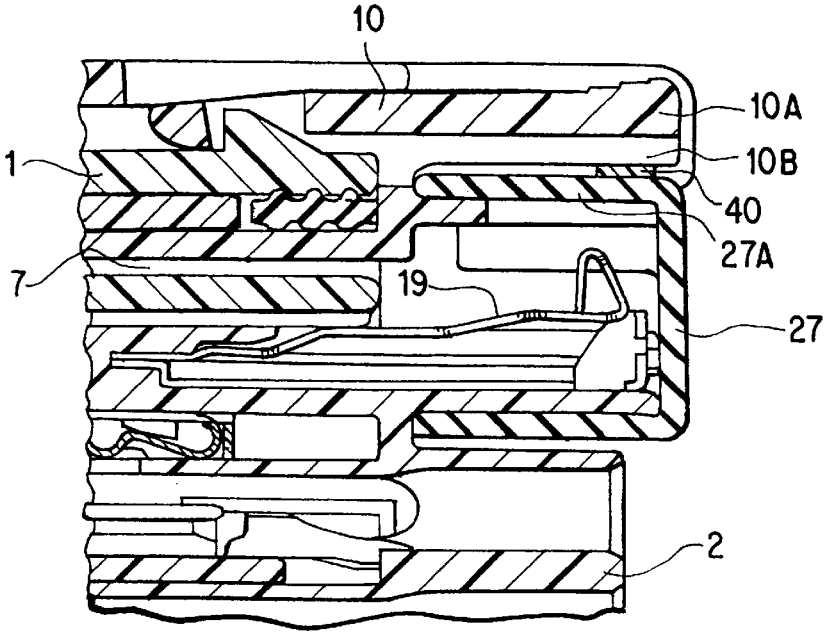
FIG. 7 is a partial cross-sectional view of a second embodiment.

Next, a second embodiment of the invention is described with the aid of FIG. 7.

This embodiment provides a means for moving in a unified manner the operating end 10A of the locking arm 10 and a portion of the sealing cover 27 described above.

Ribs 10B are provided along the left and right edges of the operating end 10A of the locking arm 10. These ribs 10B face downwards. When the locking arm 10 has been correctly fitted together and the housings 1 and 2 are in a locked state, the lower faces of the ribs 10B and the upper face 27A of the sealing cover 27 mutually face one another with a slight space between them. An adhesive 40 is applied to this space between the ribs 10B and the sealing cover 27, and by this means the operating end 10A of the locking arm 10 and a part of the upper face 27A of the sealing cover 27 adhere in such a way that they are capable of bending in a unified manner.

If the locking arm 10 and the sealing cover 27 do not bend in a unified manner, but bend independently instead, there is a possibility that, after the sealing cover 27 has been bent by the locking arm 10, the sealing cover 27 remains in that bent shape and does not resume its original shape. This is particularly likely in cases where the resilient restoring force of the short-circuiting terminal 19 is weak. However, by attaching the locking arm 10 and the sealing cover 27 so as to bend in a unified manner, the sealing cover 27 is returned to its original shape. As a result, it is also guaranteed that the short-circuiting terminal 19 can resiliently return the position where it causes the detecting terminals 7 to be short-circuited.

Figure 8:
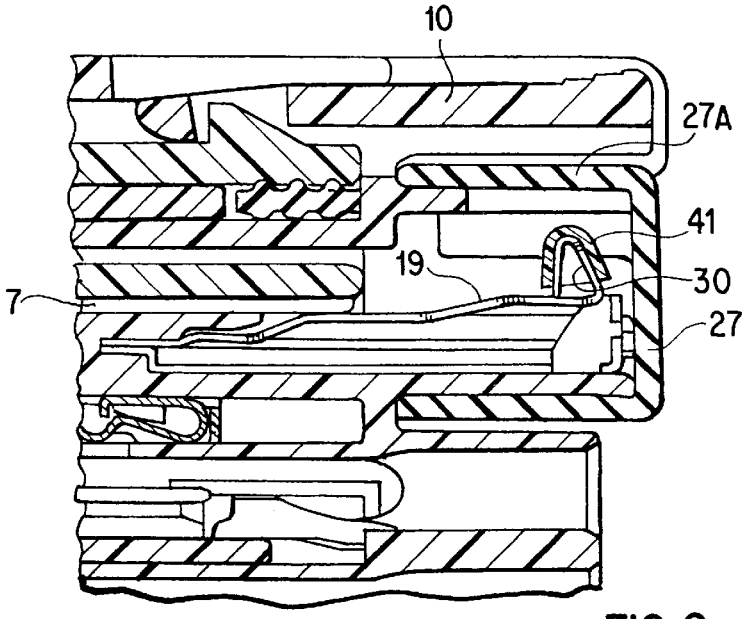
FIG. 8 is a partial cross-sectional view of a third embodiment.

Next, a third embodiment 3 of the present invention is described with the aid of FIG. 8.

This embodiment is provided with a means for avoiding direct contact between the sealing cover 27 and the short-circuiting terminal 19.

The connecting protrusions 30 of the short-circuiting terminal 19 are provided with resin caps 41 to cover these protrusions 30 within the range extending from their upper edge facing the upper face 27A of the sealing cover 27 to close to their lower edge. These caps 41 prevent direct contact between the cover 27 and terminal 19.

This embodiment avoids the possibility that the short-circuiting terminal 19, which is made of metal, cuts into or shaves the sealing cover 27. As a result, pieces of the sealing cover 27 cannot accumulate between the short-circuiting terminal 19 and the detecting terminals 7 and accordingly neither the detecting operation nor sealing is adversely effected.

Figure 9:
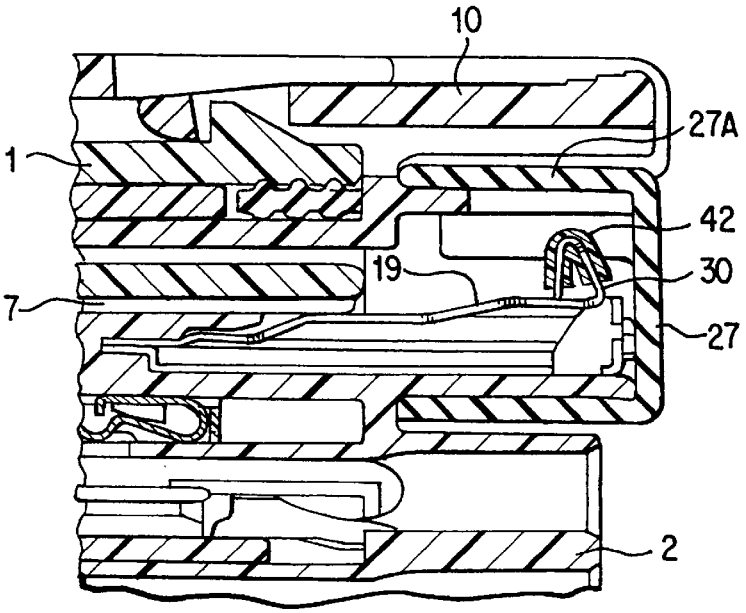
FIG. 9 is a partial cross-sectional view of a fourth embodiment.

Next, a fourth embodiment of the present invention is described with the aid of FIG. 9.

As in the third embodiment, this embodiment is also provided with a means of avoiding direct contact between the sealing cover 27 and the short-circuiting terminal 19.

Insert-moulded covering members 42 cover the connecting protrusions 30 and are formed in a unified manner with the short-circuiting terminal 19.

Figure 10:
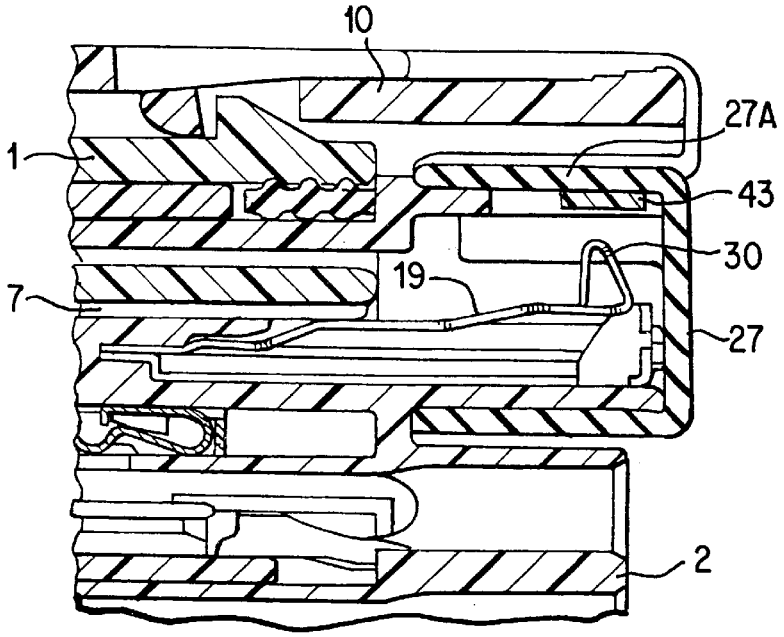
FIG. 10 is a partial cross-sectional view of a fifth embodiment.

Next, a fifth embodiment of the present invention is described below with the aid of FIG. 10.

This embodiment is also provided with a means for avoiding direct contact between the sealing cover 27 and the short-circuiting terminal 19, these means comprising a protecting plate 43 made from resin provided on the upper face 27A of the sealing cover 27 facing the connecting protrusions 30.

Figure 11:
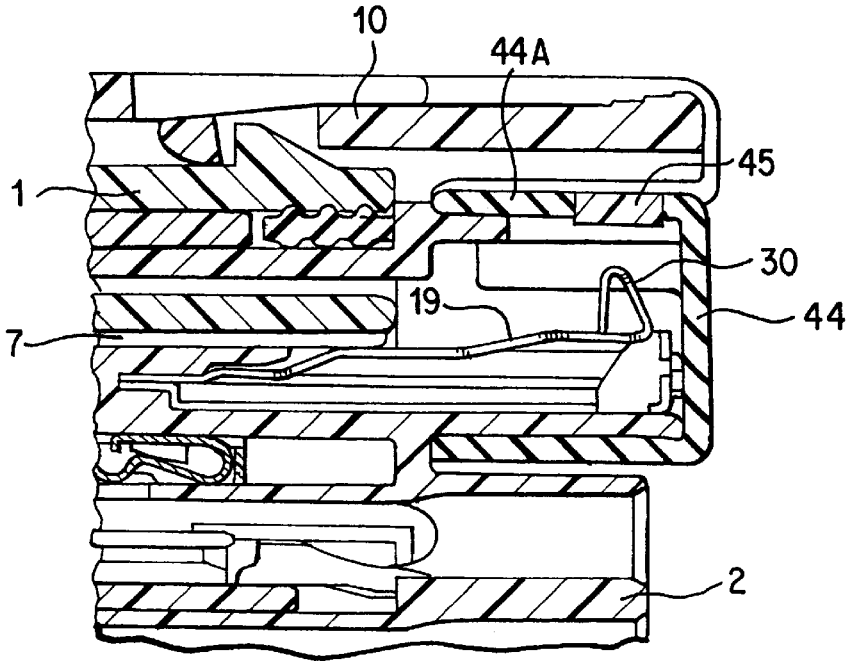
FIG. 11 is a partial cross-sectional view of a sixth embodiment.

Next, a sixth embodiment of the present invention is described with the aid of FIG. 11.

This embodiment is also provided with a means for avoiding direct contact between the sealing cover 27 and the short-circuiting terminal 19, and comprising a rubber sealing cover 44 and a contact plate member 45 made from hard resin made in a unified manner by dichromatic moulding. The contact plate member 45 is provided on an upper face 44A of the sealing cover 44 and faces the connecting protrusions 30.

In the alternative embodiments described above, the parts which have not been described have the same configuration as the first embodiment; accordingly, they have been accorded the same numbers, and an explanation of the configuration, operation and effects thereof is omitted.

The present invention is not limited to the embodiments described above. For example, the possibilities described below also lie within the technical range of the present invention. In addition, the present invention may be embodied in various other ways without deviating from the scope thereof.

(1) In the present embodiment, the sealing cover 27 is fixed to the housing by means of adhesive. It may also be attached by thermal welding, dichromatic moulding (moulding the sealing cover 27 and the housing as a single body), or other methods. The sealing cover 27 may equally be simply pushed on if the seal can be maintained.

(2) The short-circuiting terminal 19 is also not limited to the shape shown in the figures. Any form is acceptable as long as it can bend together with the bending operation of the locking arm 10.

(3) The configurations for preventing direct contact between the sealing cover and the short-circuiting terminal may equally well be applied to the second embodiment. This has the effect that in addition to the short-circuiting terminal being prevented from cutting or shaving the sealing cover, it is also provided that the short-circuiting terminal can return to the detecting position, since the sealing cover and the locking arm move in a unified manner.

(4) The second employs adhesive to ensure that the sealing cover and the locking arm move in a unified manner. However, there are other possibilities for connection. For example, it would also be possible to provide a protrusion which gets narrower towards its base, and is on the upper face of the sealing cover, to fit with a hole on the locking arm. In this way, it would be possible to separate the locking arm and the sealing cover by removing the protrusion from the hole member, thereby improving operability during maintenance, for example.

I claim:

1. An electrical connector having an exposed bendable latch arm for engagement with a mating connector in the fully fitted condition, and a short-circuit terminal engageable with a detecting terminal of a mating connector so as to complete an electrical circuit only in the fully fitted condition, characterized in that said connector further includes a flexible sealing cover, said short-circuit terminal being protected from moisture by said cover, and wherein said short-circuit terminal is movable by said exposed latch arm acting through said cover.

2. An electrical connector according to claim 1 wherein said cover and said latch arm are attached so as to move in a unified manner.

3. An electrical connector according to claim 1 and further including a protecting member co-moulded in a wall of said cover between said short-circuit terminal and latch arm, said protecting member preventing direct contact between a wall of said cover and said short-circuit terminal.

4. An electrical connector according to claim 1 characterized in that said connector includes a chamber for housing said short-circuit terminal, said chamber having an open end, and said cover comprising a resilient boot to close said open end.

5. An electrical connector according to claim 4 wherein said cover and said latch arm are attached so as to move in a unified manner.

6. An electrical connector according to claim 1 and further including a protecting member intermediate said short-circuit terminal and said cover to prevent direct contact therebetween.

7. An electrical connector according to claim 6 wherein said protecting member is moulded of plastics material directly on said short-circuit terminal.

8. An electrical connector according to claim 6 wherein said protecting member is a resilient cap of said short-circuit terminal.

9. An electrical connector according to claim 8 wherein said protecting member is adhered to said short-circuit terminal.

10. An electrical connector according to claim 6 wherein said protecting member is provided on said cover.

11. An electrical connector according to claim 10 wherein said protecting member is adhered to said cover.

12. An electrical connector according to claim 10 wherein said protecting member is relatively rigid in comparison with said cover.

13. An electrical connector according to claim 12 wherein said protecting member is adhered to said cover.

* * * * *